US009157405B2

(12) United States Patent
Matlock

(10) Patent No.: US 9,157,405 B2
(45) Date of Patent: Oct. 13, 2015

(54) STARTER MOTOR TESTING DEVICE

(71) Applicant: Tognum America Inc., Novi, MI (US)

(72) Inventor: Adam Matlock, Novi, MI (US)

(73) Assignee: MTU America Inc., Novi, MI (US)

( * ) Notice: Subject to any disclaimer, the term of this patent is extended or adjusted under 35 U.S.C. 154(b) by 282 days.

(21) Appl. No.: 13/663,110

(22) Filed: Oct. 29, 2012

(65) Prior Publication Data

US 2014/0117992 A1 May 1, 2014

(51) Int. Cl.

| | |
|---|---|
| ***F02P 17/12*** | (2006.01) |
| ***F02N 11/00*** | (2006.01) |
| ***F02N 11/08*** | (2006.01) |
| *F02N 11/10* | (2006.01) |

(52) U.S. Cl.

CPC ..... *F02N 11/006* (2013.01); *F02N 11/087* (2013.01); *F02N 11/108* (2013.01)

(58) Field of Classification Search

None

See application file for complete search history.

(56) References Cited

U.S. PATENT DOCUMENTS

| | | | | |
|---|---|---|---|---|
| 2,115,671 | A | 4/1938 | Pfister | |
| 2,636,068 | A * | 4/1953 | Perkins | 439/197 |
| 2,930,901 | A | 3/1960 | Freeman | |
| 3,873,911 | A * | 3/1975 | Champlin | 324/430 |
| 4,170,211 | A | 10/1979 | Worthington | |
| 4,745,348 | A | 5/1988 | Young | |
| 5,095,864 | A | 3/1992 | Bolenz et al. | |
| 5,701,089 | A | 12/1997 | Perkins | |
| 6,049,188 | A | 4/2000 | Smith | |
| 6,240,890 | B1 | 6/2001 | Abthoff et al. | |
| 7,156,063 | B2 | 1/2007 | Denz | |
| 7,156,065 | B2 | 1/2007 | Sommerfeld et al. | |
| 7,224,557 | B2 | 5/2007 | Kinsella et al. | |
| 7,312,968 | B2 | 12/2007 | Kahara et al. | |
| 7,443,044 | B2 | 10/2008 | Shimazaki et al. | |
| 7,750,663 | B2 | 7/2010 | Cop | |
| 7,774,110 | B2 | 8/2010 | Sago | |
| 7,821,146 | B2 | 10/2010 | Wanner | |

(Continued)

FOREIGN PATENT DOCUMENTS

| | | |
|---|---|---|
| DE | 205963 C | 1/1905 |
| DE | 144091 A1 | 9/1980 |

(Continued)

OTHER PUBLICATIONS

International Search Report and Written Opinion for Application No. PCT/US2013/067227 dated Feb. 18, 2014.

*Primary Examiner* — Melissa Koval

*Assistant Examiner* — Courtney McDonnough

(74) *Attorney, Agent, or Firm* — Honigman Miller Schwartz and Cohn LLP

(57) ABSTRACT

A control test device for testing a dual starter system has a first and a second starter. Each starter has a starter electrical interface including a starter start signal interface and a starter status signal interface. The control test device includes a first and a second communication interface for communicating a test signal to the first and second starter respectively. Each communication interface includes an electrical interface for interfacing with the first and second starter electrical interface. The test signal includes a start signal and a status signal. The start signal interfaces with one of the first and second starters start signal interface. The status signal sends a simulated status of the other one of the first and second starters to the one of the first and second starters start interface. A switch mechanism commands the start signal to one of the first and second starters.

23 Claims, 5 Drawing Sheets

(56) References Cited

U.S. PATENT DOCUMENTS

| | | | | |
|---|---|---|---|---|
| 7,861,683 | B2 | 1/2011 | Saitoh et al. | |
| 2005/0013085 | A1 | 1/2005 | Kinsella et al. | |
| 2008/0093850 | A1 | 4/2008 | Taneja et al. | |
| 2008/0100332 | A1 | 5/2008 | Tracht et al. | |
| 2008/0264374 | A1* | 10/2008 | Harris | 123/179.3 |
| 2008/0283012 | A1 | 11/2008 | Wanner | |
| 2009/0217897 | A1 | 9/2009 | Hartmann et al. | |
| 2009/0288417 | A1 | 11/2009 | Armiroli et al. | |
| 2010/0271006 | A1* | 10/2010 | Fortner | 324/126 |

FOREIGN PATENT DOCUMENTS

| | | | |
|---|---|---|---|
| DE | 3231141 | A1 | 2/1984 |
| DE | 102005006248 | A1 | 8/2006 |
| DE | 102008004381 | A1 | 7/2009 |
| DE | 102009001690 | A1 | 9/2010 |
| DE | 102009001694 | A1 | 9/2010 |
| DE | 102010030398 | A1 | 12/2011 |
| EP | 419497 | B1 | 9/1992 |
| EP | 583630 | A1 | 2/1994 |
| EP | 1851428 | A1 | 11/2007 |
| GB | 451212 | A | 7/1936 |
| GB | 1462382 | A | 1/1977 |
| GB | 2114827 | B | 11/1985 |
| JP | 60079163 | A | 5/1985 |
| JP | 10014184 | A | 1/1998 |
| JP | 11115617 | A | 4/1999 |
| JP | 2005140668 | A | 6/2005 |
| KR | 2007102542 | | 10/2007 |
| KR | 1020090057137 | | 6/2009 |
| WO | WO-8912164 | A1 | 12/1989 |
| WO | WO-2006084521 | A1 | 8/2006 |
| WO | WO-2008136913 | A1 | 11/2008 |
| WO | WO-2009089979 | A1 | 7/2009 |
| WO | WO-2009138346 | A1 | 11/2009 |
| WO | WO-2010105901 | A1 | 9/2010 |
| WO | WO-2011060901 | A1 | 5/2011 |

* cited by examiner

STARTER MOTOR TESTING DEVICE

TECHNICAL FIELD

This disclosure relates to a starter motor testing device for a dual starter system.

BACKGROUND

Internal combustion engines use electrically operated starters to initiate the rotation of the engine. Some high compression (HC) engines require a larger electrical and mechanical load than lower compression (LC) engines. Therefore, some HC engines use a parallel starting system having two or more starters coupled to the engine flywheel. In such systems, the mechanical and electrical loads are divided between the two starters. FIG. 1 shows a dual starter assembly 100 having two parallel starters 102*a*, 102*b* with respect to their control terminals. Each starter 102 has an electric starter motor and an engaging relay for engaging a pinion 104 with a flywheel ring gear 20 of the internal combustion engine. The starters 102 are electrically interconnected with one another such that the primary current path to the starter motors 102 is not closed until both pinions 104 are engaged or both engaging relays have engaged. Each starter 102 may also have a power relay. The power relay is switched to the primary current to the starter motor. In some starters, the power switches the primary current to the starter motor only when all the engaging relays have engaged.

When a user initiates the starting operations, if the first starter 102*a* has a malfunction, the second starter 102*b* will receive a signal from the first starter 102 indicating that the first starter 102*a* has a malfunction and the second starter will not attempt to turn over the engine by itself. This also occurs if the second starter 102*b* has the malfunction (i.e., the first starter 102*a* will not attempt to turn over the engine by itself). Therefore, in dual starter systems 100, both starters 102 need to be individually operational before the system 100 as a whole can be operational.

It is rare for both starters to fail simultaneously so, in situations where one of the starters 102 becomes inoperable, it becomes time consuming for a technician to determine which of the two starters 102 has failed, and consequently the technician often replaces both of the starters (even though one of them may be fully functional). This leads to higher cost of repairs and wasted time and other resources.

SUMMARY

One aspect of the disclosure provides a control test device for testing a dual starter system having a first and a second starter. Each starter has a starter electrical interface including a starter start signal interface and a starter status signal interface. The control test device includes a first and a second communication interface for communicating a test signal to the first and second starters. The first communication interface includes a first electrical interface for interfacing with the first starter electrical interface. The second communication interface includes a second electrical interface for interfacing with the second starter electrical interface. The test signal includes a start signal and a status signal. The start signal interfaces with one of the first and second starters start signal interface, and the status signal sends a simulated status of the other one of the first and second starters to the one of the first and second starters start interface. A switch mechanism commands the start signal to one of the first and second starters.

Implementations of the disclosure may include one or more of the following features. In some implementations, the control test device further includes an indicator for indicating that the control test device receives the test signal. The control test device may include a first or a second indicator for indicating that the first or second communication interface respectively is communicating with the first or second starter respectively. In some implementations, one of the first and second starters inputs an input starter signal to the control testing device and the control testing device loops back the signal as the starter status signal.

In some implementations, the control test device may be a hand-held device. The control test device may include a first and a second cable harness, each cable harness connects to the first and second communication interfaces respectively. The first and second communication interfaces may each have a pinout with 5 pins, or spring clips.

Another aspect of the disclosure provides, a control test device for testing a dual starter system having a first and a second starter. Each starter has a starter electrical interface. The starter electrical interface includes a starter start signal interface and a starter status signal interface. The control test device includes first means for communicating a test signal to the first starter, and second means for communicating the test signal to the second starter. The test signal includes a start signal and a status signal. The start signal interfaces with one of the first and second starters start signal interface, and the status signal sends a simulated status of the other one of the first and second starters to the one of the first and second starters start interface. The control test device includes means for commanding the start signal to one of the first and second starters.

Implementations of the disclosure may include one or more of the following features. In some implementations, the control test device includes means for indicating that the control test device receives the test signal. The control test device may include first means for indicating that the first communication interface communicates with the first starter. The control test device may include a second means for indicating that the second communication interface communicates with the second starter. In some examples, one of the first and second starters inputs an input starter signal to the control testing device and the control testing device loops back the signal as the starter status signal.

In some implementations, the control test device further includes a first and a second cable harness. Each cable harness connects to the first and second communication interfaces respectively. In some examples, the first and second means for communicating each has a pinout having 5 pins, or spring clips. The control test device may be a hand-held device.

Another aspect of the disclosure provides a testing method for testing a dual starter system having a first and a second starter. Each starter having a starter electrical interface including a starter start signal interface and a starter status signal interface. The testing method includes communicating a test signal to the first starter. The test signal includes a start signal and a status signal. The start signal for interfacing with one of the first and second starters start signal interface, and the status signal for sending a simulated status of the other one of the first and second starters to the one of the first and second starters start interface. The testing method includes communicating the test signal to the second starter and commanding the start signal to one of the first and second starters.

Implementations of the disclosure may include one or more of the following features. In some implementations, the testing method further includes indicating that the control test device receives the test signal. The testing method may include indicating that the first communication interface communicates with the first starter, or indicating that the second communication interface communicates with the second starter. In some examples, one of the starters inputs an input starter signal to the control testing device and the control testing device loops back the signal as the starter status signal.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
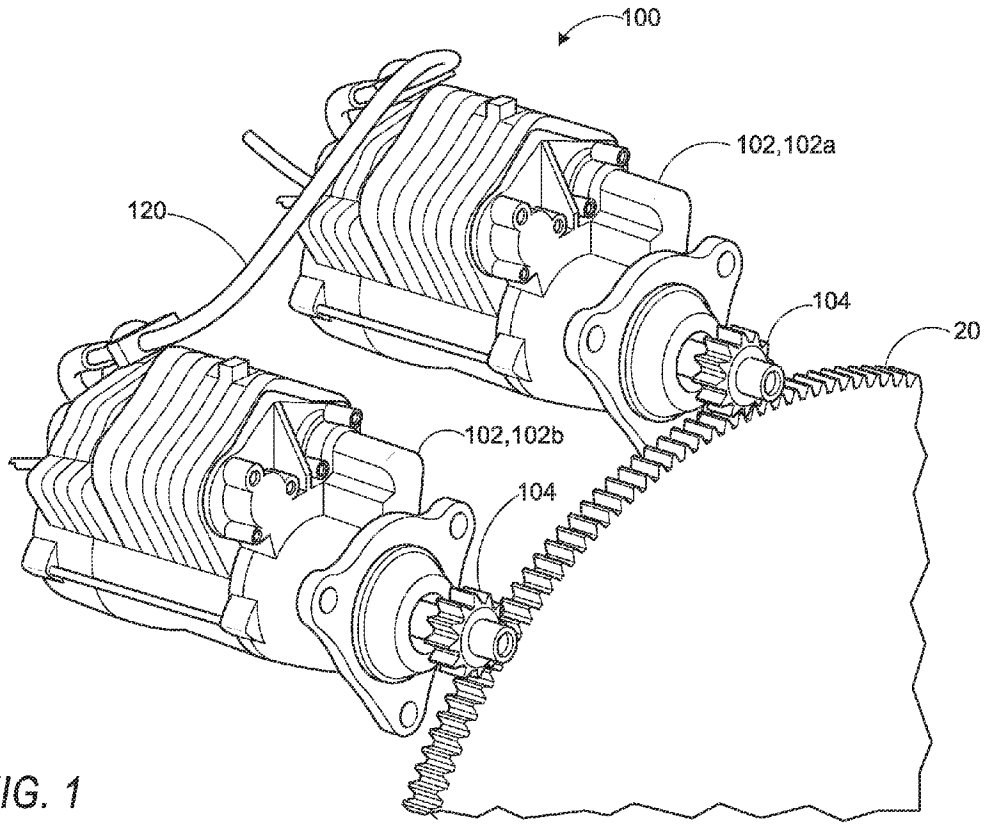
FIG. 1 is a perspective view of a dual starter assembly known from the related art.

Referring to FIG. 1, a starter motor assembly 100 includes a first starter 102*a* joined to a second starter 102*b* by a jumper cable harness 120. Each starter includes a respectively associated starter motor (not shown). The torque of both starter motors is required to start an engine. The first 102*a* and second 102*b* starters are connected in parallel with respect to their control terminals. The first 102*a* and the second 102*b* starters are electrically interlocked such that upon failure of one of the starters 102, the remaining starter 102 does not attempt to turn the engine over by itself. The interlocking system prevents a fully functional starter motor assembly 100 from malfunctioning because a dual starting system operating at one half of its capacity will eventually overload the good starter and cause it to fail.

Each starter 102 receives a command start signal (e.g., 24V). Each starter is adapted to receive a key engine crank command signal and a neighbor-status input signal (from its neighboring starter), and to send a self-status signal (to its neighboring starter). However, when one of the starters 102 fails, it fails to send the appropriate "ENGAGED" signal to the neighboring starter. Without the ENGAGED signal, the neighboring starter will not exert a torque on the engine flywheel.

When the second starter 102*b* receives an ENGAGED status signal from the first starter 102*a*, the ENGAGED neighbor-status signal received indicates that the first motor starter 102*a* is operational. When the first starter 102*a* receives an ENGAGED neighbor-status signal from the second starter 102*b*, the neighbor-status signal received indicates that the second starter 102*b* is operational. Therefore, if one starter 102 or both starters 102*a*, 102*b* fails then both starters 102 are locked out. This lockout functionality prohibits the second operable starter 102 from attempting to start an engine by itself. In some instances, if the one operable starter 102 attempts to start the engine on its own, the one operable starter 102 may be damaged since it may not be sized to handle both the load that it usually handles (when both starters are functioning) and the load that the other starter 102 normally handles.

In most circumstances, it is very unlikely that both starters 102 will fail at the same time. However, because of the inoperative condition of the entire assembly 100, a repair technician may nevertheless return both starters 102, even though one of the starters 102 may be fully functional and does not require service. In addition, the lockout functionality of the starter motor assembly 100 makes it difficult to independently test each starter 102 in the starter assembly 100 and determine which starter 102 is inoperable.

Figure 2:
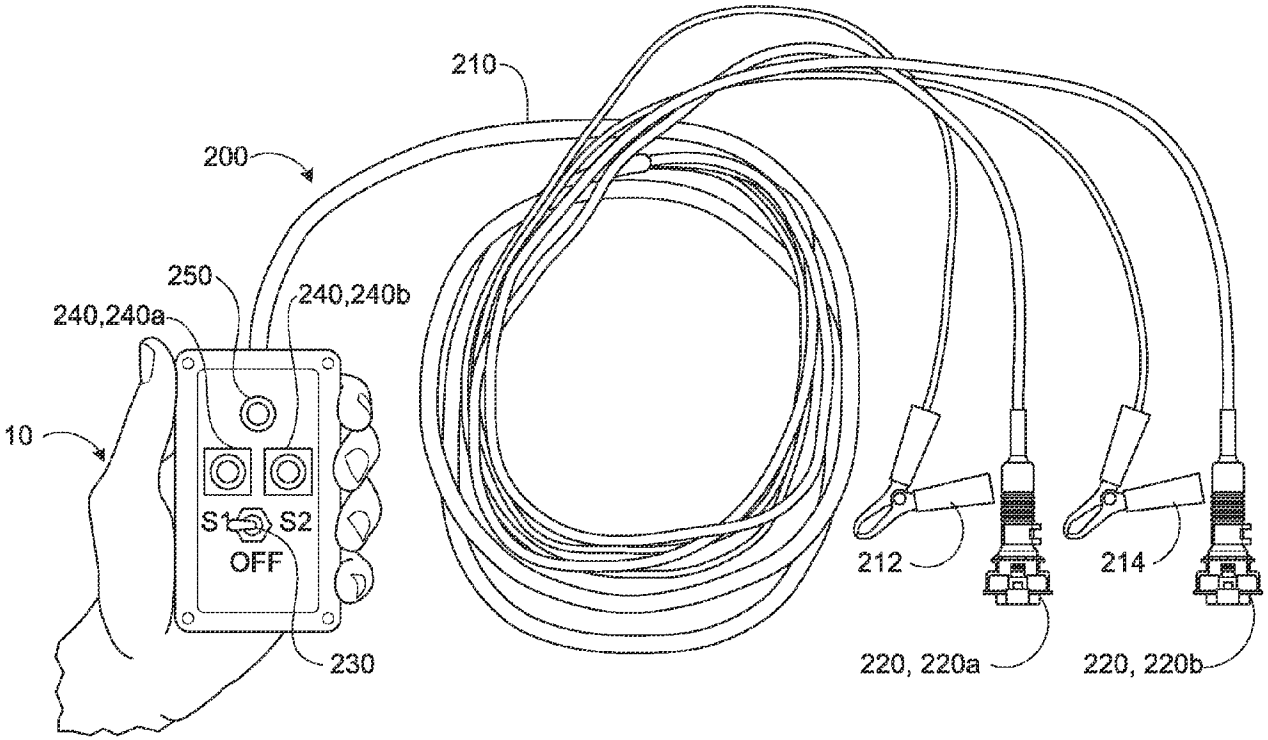
FIG. 2 is a schematic view of an exemplary control test device.

Referring to FIG. 2, in some implementations, a technician 10 may use a test device 200 to determine which one of the two starters 102 failed. In some examples, the test device 200 is a standalone device connected to a larger immovable diagnostics device. In other embodiments, the test device 200 may be a handheld device 200 that allows the technician 10 more flexibility regarding locations of where to diagnose a vehicle (e.g., if the vehicle has stopped on the side of the road, the technician may go to the location of the vehicle and test the dual starter assembly 100).

In some implementations, the test device 200 is connected to a cable harness 201 having a positive cable 212 (e.g., red) and a negative 214 cable (e.g., black). The positive cable 212 is connected to the power supply from the starter assembly 100 and the negative cable 214 is connected to the ground from the starter assembly 100. The cable harness 210 has two electrical interfaces 220 to connect with the electrical interface 106 of the starters 102. Once the technician 10 connects the test device 200 to the starters 102 then the technician 10 can switch the switching mechanism 230 to determine which one of the two starters 102*a*, 102*b* to test.

In some implementations, the test device 200 has an electric switch mechanism 230 (e.g., an electrical selector switch) for directing the start signal to the first 102*a* or the second 102*b* starter. The technician 10 manipulates the switch mechanism 230 to select one of the starters 102 he/she wants to test. In some examples, the switch mechanism 230 may be a toggle switch with three positions. An off position indicates that the test device 200 is not sending a start signal (e.g., 24V) to either one of the starters 102. A first position to indicate that the test device 200 is testing the first starter 102*a* and a second position to indicate that the test device 200 is testing the second starter 102*b*. In some examples, the test device 200 has three separate buttons each button (i.e., electrical switch) indicating an off status, testing the first starter 102*a*, or testing the second starter 102*b*.

Figure 3:
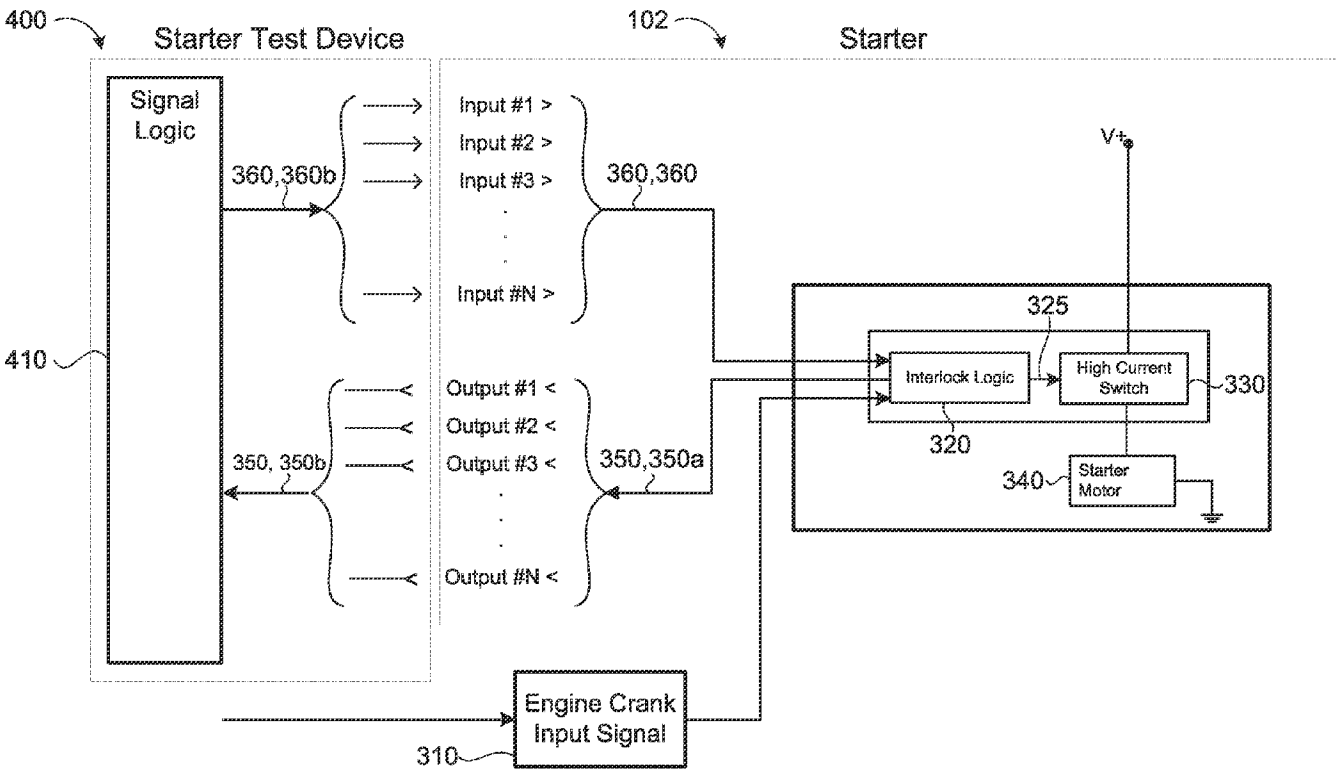
FIG. 3 is an electric schematic of an exemplary control test device in communication with one of the starters from the dual starter assembly.

Referring to FIG. 3, in some implementations, one of the starters 102 from the starter assembly 100 electrically communicates with a starter test device 200. The starter 102 may have inputs 1-N, and may have outputs 1-N. When a driver attempts to start the vehicle, an engine crank signal 310 is sent to the interlock system 320 of the starter 102. The interlock system 320 may be made up of electric relays (or other electronic/electrical components capable of carrying out Boolean-type logic operations) arranged to carry out logic operations to control the behavior of the starter system based on the operation of each starter. The interlocking system 320 may use any type of logic elements such as relays, solid state logic gates or the like.

When the starter 102 receives the crank signal 310, the interlock system 320 sends a self-status signal 350 to the other starter 102. When the starter 102 receives a neighbor-status signal 360 indicating that the other starter is operational, the interlock system sends a signal 325 to the high current switch 330 indicating that the starter motor 340 can be engaged.

When the interlock system 320 sends the signal 325 to the switch 320, the switch 320 closes the circuit and sends the signal to the starter motor 340 to engage the pinion 104 with the fly wheel 20, and consequently start the vehicle. The interlock system 320 of the starter 102 safeguards the starter assembly 100 from malfunctioning by not sending the signal 325 to the switch 330 unless two conditions have been met. The first condition includes receiving a neighbor-status signal 360,360*a* from the other starter 102*b*, and sending a self-status signal 350,350*a* to the other starter 102*b*. The starter device 200 receives the self-status signal 360*a* from the starter 102 as a neighbor-status signal 350*b* and falsely sends a self-status signal 360*b* indicating to the starter 102*a* that it is receiving a neighbor-status signal 360*a*.

Figure 4:
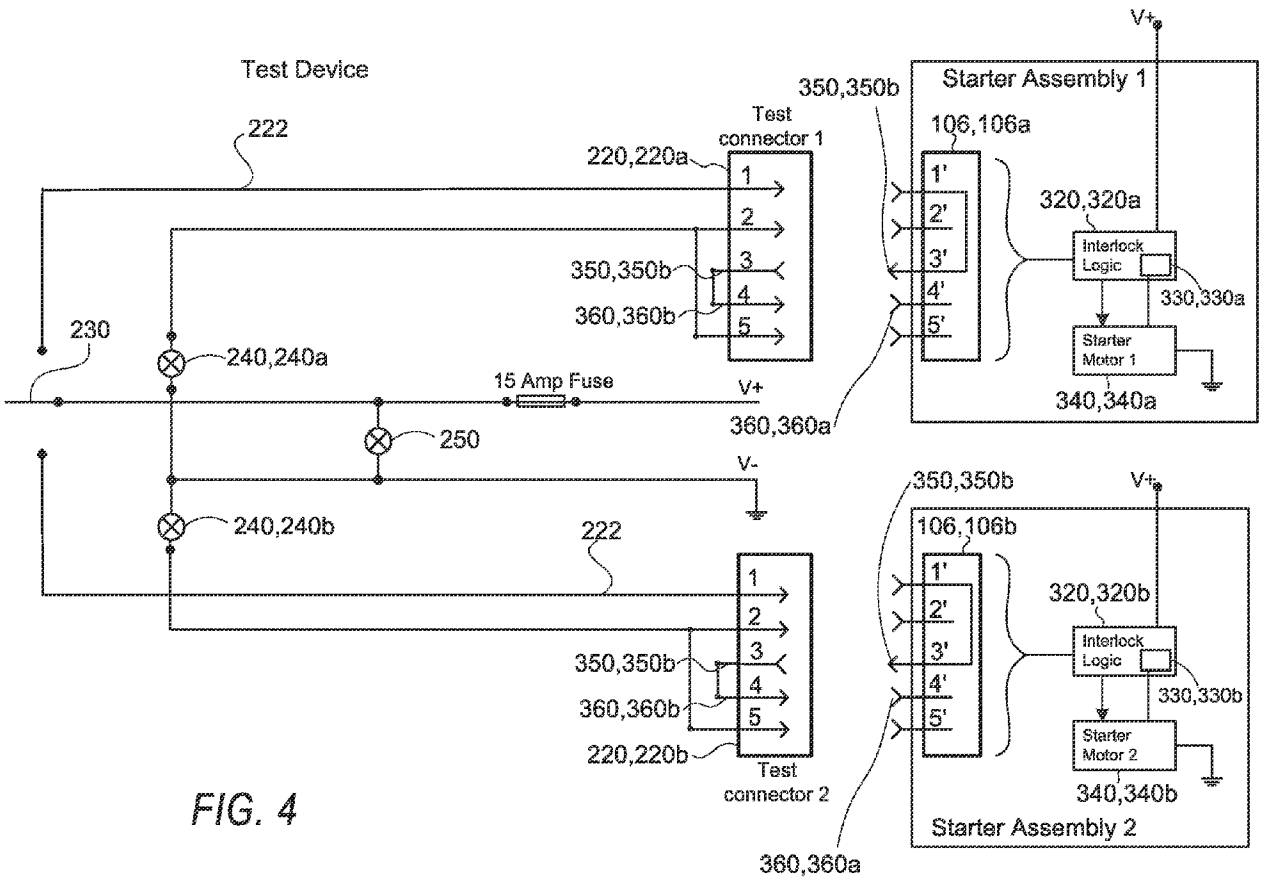
FIG. 4 is an electric schematic of an exemplary control test device.
Figure 5:
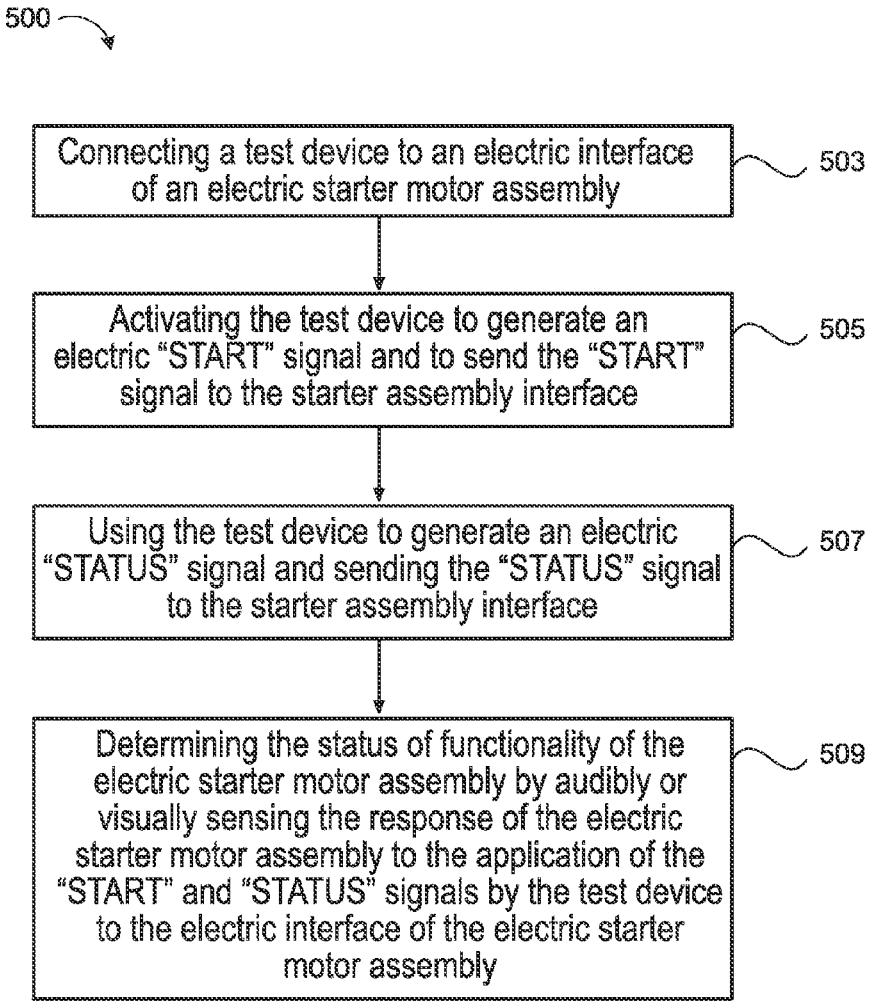
FIG. 5 is a schematic view of an exemplary arrangement of operations for the control test device.

Referring to FIG. 4, each starter 102 has an electrical interface 106 that connects with an electrical communication interface 220 of the test device 200. The technician 10 connects each of the test device 200 communication interfaces 220*a* and 220*b* to the first 106*a* and second 106*b* starter electrical interface respectively. Each starter electrical interface 106 has a starter start signal interface and a starter status signal interface. The test device 200 electrical interface 220 connects to the starter electrical interface 106. In some examples, one of the starter 106 and the test interfaces 220 has a male plug and the other one has a female receptacle. The male plug has several pins that are inserted in the openings of the female receptacle. In some examples, the electrical interface of one of the starter 106 and the test device 220 uses spring clips each connecting to the pins of the other one of starter and test device interface. Other arrangements or configurations are possible as well.

In normal operation of the dual starter assembly 100, the starter start signal interface 106 receives a start signal for starting the starter 102. The starter status signal interface receives a neighbor-status single 360*a* from the other starter 102 indicating that the other starter 102 is operational. Therefore, in order to test one starter 102, a self-status signal 360*b* is simulated to be received as a neighbor-status signal 360*a* by the starter 102 being tested. Thus, in order to test one of the starters 102, a neighbor-status signal 360*a* is simulated to act as the other starter self-status signal 360*b* and indicate that the other starter is operational. If a neighbor-status signal 360*a* is not received, then the other starter is considered inoperable. Therefore, the test device overrides the interlock system 320 and allows one of the starters 102 to operate without the other being operational. Referring back to FIG. 4, in some examples, the communication interface 220 of the test device 200 has 5 pins (e.g., pins 1-5), each pin 1-5 has a corresponding female receptacle 1'-5' in the starter electrical interface 106. When the technician 10 switches the switching mechanism 230 to the S1 position to test the first starter 106*a*, a test signal 222 goes through pin 1 of the communication interface 220 to the pin 1' of the starter electrical interface 106*a*. The starter electrical interface 106*a* sends a self-status signal 350*a* through pin 3' to pin 3 of the communication interface 220*a*, where the communication interface receives the signal 350*a* as a neighbor-status signal 350*b*. The communication interface 220*a* sends a self-status signal 360*b* to the starter electrical interface 160*a* received as a neighbor-status signal 360*a* the false operation of the other starter 102*b*. Therefore, the signals 350 and 360 allow the simulation of the second starter 102*b* sending a status signal indicating that it is functional. The test device 200 is configured electrically, such that the starter 106*a* that is being tested receives sufficient electrical signals 222 at the appropriate harness pins (e.g., 1'-5') such that the starter 106*a* interlock circuit is satisfied that a second starter motor 106*b* has started. Thus, the starter 106*a* under test will attempt to engage (if it is operating correctly). Upon determining which of the two starters 102 failed, the fully functional starter 102 may be left intact while the starter 102 requiring service is removed from the assembly 200 and sent to the manufacturer for service.

In some implementations, the test device has an indicator 250 for indicating that the test device is sending a start signal to one of the starters. Additionally or alternatively, the test device has an indicator 240 for each of the starters tested, where each indicator indicates the failed component in each starter. These indicators 240, 250 may be a light indicator that turns on when the switch is turned to either the first 102*a* or second 102*b* starters and the test device 200 sends a test signal 222. In some examples, the indicator 240, 250 is a digital indicator. Other arrangement or configurations of indicators are possible as well.

In some implementations, a control test device 200 for testing a dual starter system 100 has a first 102*a* and a second 102*b* starter. Each starter has a starter electrical interface 106. The starter electrical interface 106 includes a starter start signal interface and a starter status signal interface. The control test device 200 includes first means for communicating a test signal 220*a* to the first starter 102*a*, and second means for communicating the test signal 220*b* to the second starter 102*b*. The test signal 222 includes a start signal and a status signal. The start signal interfaces with one of the first and second starters start signal interface, and the status signal sends a simulated status of the other one of the first and second starters to the one of the first and second starters start interface. The control test device includes means for commanding 230 the start signal to one of the first 102*a* and second 102*b* starter.

In some examples, the control test device 200 includes means for indicating 230 that the control test device receives the test signal 222. The control test device may include first means for indicating 240*a* that the first communication interface communicates with the first starter 102*a*. The control test device 200 may include a second means for indicating 240*b* that the second communication interface communicates with the second starter 102*b*. In some examples, one of the first and second starters 102 inputs an input starter signal to the control testing device 200 and the control testing device 200 loops back the signal as the starter status signal.

In some implementations, the control test device further includes a first and a second cable harness 210. Each cable harness connects to the first and second communication interfaces respectively. In some examples, the first and second means for communicating each has a pinout having 5 pins, or spring clips. The control test device 200 may be a hand-held device.

FIG. 4 provides an exemplary arrangement of operations for a method 500 of testing a dual starter system 200 having a first and a second starter. Each starter has a starter electrical interface which includes a starter start signal interface (a.k.a. starter crank signal interface) and a starter status signal interface. The testing method 500 includes generating a test signal and communicating the test signal to the first starter 502. The test signal is generated in the control test device and includes a START signal 503 (a.k.a. a crank signal) and a STATUS signal 505. The START signal is coupled to the start signal interface of the first starter, and the STATUS signal is coupled to the start interface of the first starter. Additionally, the testing method 500 also may include communicating a START signal to the second starter 504 and communicating a STATUS signal to the second starter 504. The operational state of the electric motor can be easily determined by the test technician by monitoring (either audibly or visually) the starter's response to the application of the START and STATUS electric signals (i.e., the electric starter motor should give some indication that it is engaging the flywheel).

Implementations of the disclosure may include one or more of the following features. In some implementations, the testing method further includes indicating that the control test device receives the test signal. The testing method may include indicating that the first communication interface communicates with the first starter, or indicating that the second communication interface communicates with the second starter. In some examples, one of the starters inputs an input starter signal to the control testing device and the control testing device loops back the signal as the starter status signal.

A number of implementations have been described. Nevertheless, it will be understood that various modifications may be made without departing from the spirit and scope of the disclosure. Accordingly, other implementations are within the scope of the following claims.

What is claimed is:

1. A control test device for testing a dual starter system having a first and a second starter, each starter having a starter electrical interface including a starter crank signal interface and a starter status signal interface, the control test device comprising:

a first communication interface for communicating an electrical test signal to the first starter, wherein the first communication interface includes a first electrical interface for interfacing with the first starter electrical interface;

a second communication interface for communicating the electrical test signal to the second starter, wherein the second communication interface includes a second electrical interface for interfacing with the second starter electrical interface;

a switch mechanism operable to direct the electrical test signal to the first starter or the second starter, each of the first and second starters electrically interlocked from starting unless the corresponding starter receives a neighbor-status signal indicating that the other starter is operational; and an electric circuit for generating the electrical test signal directed to the first starter to test whether the first starter is inoperable when the switch mechanism is operable in the first position, the electrical test signal including:

an electric crank signal communicated to the crank signal interface of the first starter to start the first starter; and an electric status signal communicated to the starter status signal interface of the first starter, the electric status signal simulating the neighbor-status signal indicating that the second starter is operational.

2. The control test device of claim 1, further comprising an indicator for indicating that the control test device sends the test signal to the one of the first and second starters.

3. The control test device of claim 1, further comprising a first indicator for indicating that the first communication interface communicates with the first starter.

4. The control test device of claim 1, further comprising a second indicator for indicating that the second communication interface communicates with the second starter.

5. The control test device of claim 1, wherein one of the first and second starters inputs an input starter signal to the control testing device and the control testing device loops back the signal as the starter status signal.

6. The control test device of claim 1, further comprising a first and a second cable harness, each cable harness connecting to the first and second communication interfaces respectively.

7. The control test device of claim 1, wherein the first and second communication interfaces each comprising a pinout having 5 pins.

8. The control test device of claim 1, wherein the first and second communication interfaces each comprising spring clips.

9. The control test device of claim 1, wherein the control test device is a hand-held device.

10. A control test device for testing a dual starter system having a first and a second starter, each starter having a starter electrical interface including a starter start signal interface and a starter status signal interface, the control test device comprising:

first means for communicating a test signal to the first starter;

second means for communicating the test signal to the second starter;

means for directing the test signal to the first starter or the second starter, each of the first and second starters electrically interlocked from starting unless the corresponding starter receives a neighbor-status signal indicating that the other starter is operational; and means for commanding the test signal to the first starter to test whether the first starter is inoperable, wherein the test signal includes:

a start signal communicated to the start signal interface of the first starter to start the first starter; and a status signal communicated to the status signal interface of the first starter, the status signal simulating the neighbor-status signal indicating that the second starter is operational.

11. The control test device of claim 10, further comprising means for indicating that the control test device sends the test signal.

12. The control test device of claim 10, further comprising a first means for indicating that the first starter receives the test signal.

13. The control test device of claim 10, further comprising:

means for commanding the test signal to the second starter to test whether the second starter is inoperable, wherein the test signal includes:

a start signal communicated to the start signal interface of the second starter to start the second starter; and a status signal communicated to the status signal interface of the second starter, the status signal simulating the neighbor-status signal indicating that the first starter is operational; and a second means for indicating that the second starter receives the test signal.

14. The control test device of claim 10, wherein one of the first and second starters inputs an input starter signal to the control testing device and the control testing device loops back the signal as the starter status signal.

15. The control test device of claim 10, further comprising a first and a second cable harness, each cable harness connecting to the first and second means for communicating respectively.

16. The control test device of claim 10, wherein the first and second means for communicating the test signal each comprising a pinout having 5 pins.

17. The control test device of claim 10, wherein the first and second means for communicating the test signal each comprising spring clips.

18. The control test device of claim 10, wherein the control test device is a hand-held device.

19. A testing method for testing a dual starter system having a first and a second starter, each starter having a starter electrical interface including a starter start signal interface and a starter status signal interface, the testing method comprising:

communicating a test signal to the first starter when a switch mechanism is operable in a first position;

communicating the test signal to the second starter when the switch mechanism is operable in a second position, each of the first and second starters electrically interlocked from starting unless the corresponding starter receives a neighbor-status signal indicating that the other starter is operational; and commanding the start signal to the first starter to test whether the first starter is inoperable, the test signal including:

an electric crank signal communicated to the starter start signal interface of the first starter to start the first starter; and an electric status signal communicated to the starter status signal interface of the first starter, the electric status signal simulating the neighbor-status signal indicating that the second starter is operational.

20. The testing method of claim 19, further comprising indicating that the control test device sends the test signal.

21. The testing method of claim 19, further comprising indicating that the start signal is sent to the first starter.

22. The testing method of claim 19, further comprising indicating that the start signal is sent to the second starter.

23. The testing method of claim 19, wherein one of the starters inputs an input starter signal to the control testing device and the control testing device loops back the signal as the starter status signal.

* * * * *

UNITED STATES PATENT AND TRADEMARK OFFICE

CERTIFICATE OF CORRECTION

PATENT NO. : 9,157,405 B2
APPLICATION NO. : 13/663110
DATED : October 13, 2015
INVENTOR(S) : Matlock It is certified that error appears in the above-identified patent and that said Letters Patent is hereby corrected as shown below:

On the title page item [71] delete "Tognum America Inc." and insert --MTU America Inc.--

Signed and Sealed this
Twenty-fourth Day of May, 2016

Michelle K. Lee

Michelle K. Lee
*Director of the United States Patent and Trademark Office*